US007281876B2

(12) United States Patent
Kwon

(10) Patent No.: US 7,281,876 B2
(45) Date of Patent: Oct. 16, 2007

(54) COSMETIC CASE CAPABLE OF OPENING AND/OR CLOSING CONTENT OUTLET

(75) Inventor: Hyuktak Kwon, Anyang-si (KR)

(73) Assignee: Chun Kyung Co., Ltd., Anyang-Si (KR)

( * ) Notice: Subject to any disclaimer, the term of this patent is extended or adjusted under 35 U.S.C. 154(b) by 0 days.

(21) Appl. No.: 11/373,788

(22) Filed: Mar. 10, 2006

(65) Prior Publication Data

US 2006/0204318 A1 Sep. 14, 2006

(30) Foreign Application Priority Data

Mar. 14, 2005 (KR) ..... 20-2005-006798

(51) Int. Cl.
*B43K 1/06* (2006.01)
*B43K 23/12* (2006.01)

(52) U.S. Cl. ..... 401/265; 401/262

(58) Field of Classification Search ..... 401/262, 401/202, 269, 121, 122, 265; 222/502, 503, 222/544, 547, 556, 557, 550, 562
See application file for complete search history.

(56) References Cited

U.S. PATENT DOCUMENTS 3,400,997 A * 9/1968 Schwartzman ..... 401/186
4,609,300 A * 9/1986 Robert ..... 401/122
4,739,906 A * 4/1988 LoTurco ..... 222/212
5,667,084 A * 9/1997 Duggal et al. ..... 215/11.4

* cited by examiner

*Primary Examiner*—David J. Walczak
(74) *Attorney, Agent, or Firm*—Ladas & Parry LLP

(57) ABSTRACT

A cosmetic case capable of opening and/or closing a content outlet contains a tint-care cosmetic which is discharged by utilizing a cap of the cosmetic case. The cosmetic case includes a content outlet formed to align in parallel to the opening portion of the case, an opening/closing regulating member, an outer body which is located outside the opening/closing regulating member and connected to the opening portion of the case, a nozzle lip connected to the upper portion of the outer body and a cap to protect the nozzle tip.

3 Claims, 6 Drawing Sheets

COSMETIC CASE CAPABLE OF OPENING AND/OR CLOSING CONTENT OUTLET

CROSS-REFERENCE TO RELATED PATENT APPLICATIONS

This application claims the benefit of Korean Utility Model Application No. 20-2005-0006798, filed on Mar. 14, 2005, in the Korean Intellectual Property Office, the disclosure of which is incorporated herein in its entirety by reference.

BACKGROUND OF THE INVENTION

1. Field of the Invention

The present invention relates a cosmetic case for containing tint-care cosmetic, more particularly, to a cosmetic case capable of opening and/or closing a content outlet, through which contained tint-care cosmetic is discharged by utilizing a cap of the cosmetic case.

2. Description of the Related Art

For the purpose of skin protection or pursuit of beauty, ladies usually makeup with tint-care cosmetic such as foundation, compact, face powder, lipstick, lip gloss, etc, after makeup with skin-care cosmetic. According to use and component of the tint-care cosmetic, not only appropriate structure for maintaining tint-care cosmetic differs from each other but also the way how to makeup differs from accordingly.

There is one type of tint-care cosmetic for which separate instrument for example, a powder puff, is used to makeup whilst there is another type which is contained in a case having a nozzle tip which is equipped to discharge contained tint-care cosmetic toward a content outlet and is rubbed on a desired portion when makeup.

As representative tint-care cosmetic to be rubbed on a desired portion to makeup, lipstick, lip gloss, cheek touch, foundation, etc, can be referred to. Because those tint-care cosmetic are of oily gel type, it is possible to makeup by rubbing discharged tint-care cosmetic through the nozzle tip on the skin directly. Also because it is rubbed on the skin when makeup not only it can permeate through the skin easily but also effective makeup can be performed even with a small amount.

Because those tint-care cosmetic to rub on the skin when makeup, including lipstick, lip gloss, cheek touch, cream, eye gel, etc, are of oily gel type, it is preferable to prevent oil component from evaporating and further to block contained tint-care cosmetic in a case from contacting with the air, thoroughly.

FIG. 1 show a case which contains representative tint-care cosmetic such as lipstick, lip gloss (hereinafter refers to content). The case includes a case 100 for containing content, a nozzle tip 120 which is connected to the opening portion 111 of the case 110 and a cap 130 which covers the nozzle tip 120.

When makeup with content contained in the case 110, the cap 130 is separated from the nozzle tip 120, an amount of content is discharged through a discharging hole 121 of the nozzle tip 120 by pressing the case 110 or by holding the case 110 upside down and then discharged content is rubbed to the desired portion of the skin (ex. lips) to makeup.

After makeup is finished, the nozzle tip 120 is covered with the cap 130 to maintain, a blocking stick 131 which is formed inside the cap 130 is inserted into the discharging hole 121 of the nozzle tip 120 so that the content in the case 110 is blocked from contacting to the air as well as its oil component is protected from evaporating.

Because the conventional case 110, where gel-typed tint-care cosmetic for example, lipstick or lip gloss, is contained inside, is formed to block the discharging hole 121 of the nozzle tip 120 by the blocking stick 131 formed in the cap 130, it cannot maintain the cosmetic safely when the block stick 131 is broken during being used.

The reason why the blocking stick 131 of the cap 130 covering the nozzle tip 120 for protection is broken is as follows.

If the cap 130 is pressed to cover while the cap 130 is not aligned in parallel to the case 110, because the cap 130 is covered while the blocking stick 131 is not inserted into the discharging hole 121 of the nozzle tip 120, as shown in FIG. 2, the blocking stick 131 is damaged to break.

If the blocking stick 131 of the cap 130 is broken, complete sealing cannot be done so that gel-typed cosmetic should become harden as oil component of the tint-care cosmetic evaporates.

Further, if the discharging hole 121 of the nozzle tip 120 is maintained opened due to the damage of the blocking stick 131 of the cap 130, content is discharged outside when external force presses the case 110. Still further, inner side of the cap 130 becomes dirty and unnecessarily discharged content is hardened to be impossible to use.

Those problems cause to reduce confidence of tint-care cosmetic which is to be rubbed on the skin directly when makeup.

Although it is explained with respect to an exemplary case having a nozzle tip made with hard material, similar problems can be occurred for a case having a nozzle tip made with soft material for example, brush, rubber, cloth, sponge, etc.

Especially, it is impossible to block the discharging hole in the cosmetic case having a nozzle tip made with a soft material for example, brush, rubber, cloth, sponge, etc, unlike the cosmetic case having a nozzle tip made with a hard material. Thus a cosmetic case capable of blocking a content outlet through content is discharged is needed.

SUMMARY OF THE INVENTION

The object of the present invention is to provide a cosmetic case capable of opening and/or closing a content outlet.

According to the present invention, an opening/closing knob of an opening/closing regulating member, which is located outside the content outlet and aligned in parallel to the opening portion of the case, is operated by a cap, which covers a nozzle tip, in order to open or close the content outlet.

Thereby, it is possible to prevent tint-care cosmetic from discharging through the content outlet unnecessarily when carrying and to solve the problem where leaked content is harden to cast.

Further, because evaporation of oil component does not occur, tint-care cosmetic can be applied smoothly regardless of used duration so that beautiful makeup can be performed.

Object of the present invention can be achieved by providing a cosmetic case capable of makeup by rubbing it on the desired portion of the skin, the cosmetic case including:

a content outlet 20 where a packing flange 22 and a circular locking ledge 23 are formed at the lower portion and upper portion respectively, wherein the packing flange 22 is contacted, face to face, with the upper circumference of an opening portion 11 of the case 10 containing content and the circular locking ledge 23 is hanged to fix to a circular rim 43 of an outer body 40 which is connected to the opening portion 11;

an opening/closing regulating member 30 having opening/closing knobs 31 on the both sides which opens and closes a content transferring path 21 of the content outlet 20 selectively;

an outer body connected to the opening portion 11 of the case 10 where holes 41 are formed at the both sides to which a protruding portion 31*b* of the opening/closing knob 31 of the opening/closing regulating member 30 and a nozzle tip connection portion 42, to which a nozzle tip 50 is connected, is formed at the upper portion;

a nozzle tip 50 connected to the upper portion of the outer body 40 and having a pressing tube 52 which is extended in parallel to a discharging hole 51 so at to press the circular locking ledge 23 of the content outlet 20 so that the circular locking ledge 23 is fixed tightly to the circular rim 43 of the outer body 40; and a cap 60 to protect the nozzle tip 50 and to operate the opening/closing knob 31 of the opening/closing regulating member 30 when separated.

Additional aspects and/or advantages of the present invention will be set forth in part in the description which follows and, in part, will be obvious from the description, or may be learned by practice of the invention.

BRIEF DESCRIPTION OF THE DRAWINGS

The above and other features and advantages of the present invention will become more apparent by describing in detail preferred embodiments thereof with reference to the attached drawings in which.

*Brief description of numerals in drawings*

Figure 1:
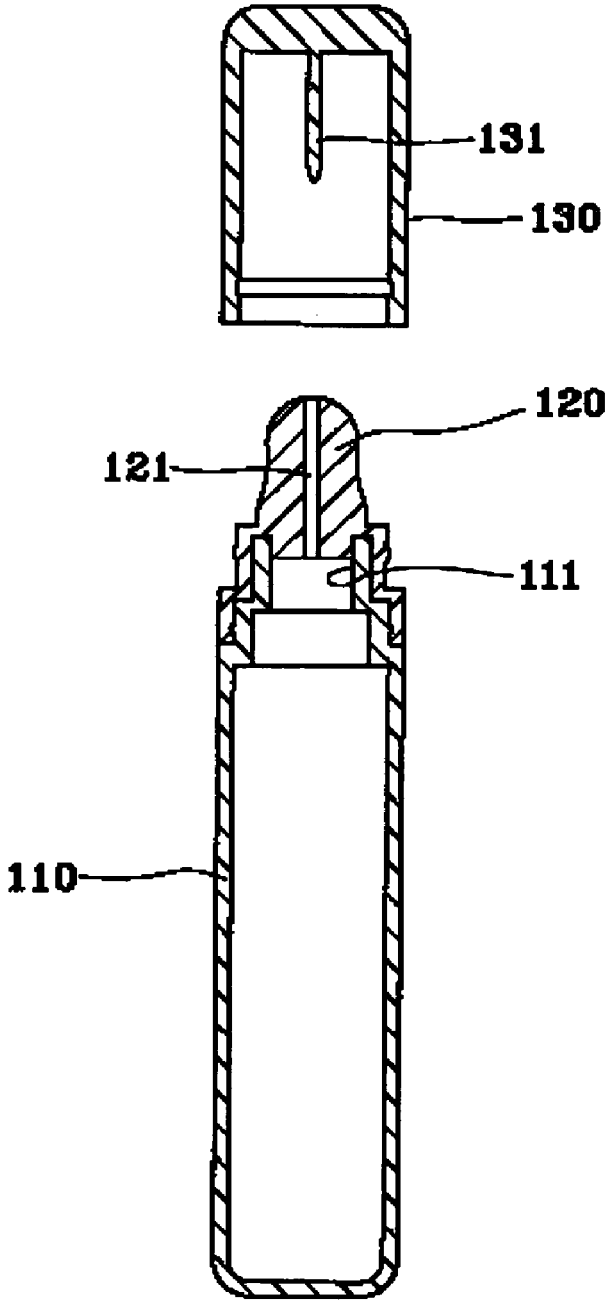
Fig. 1 Prior Art
FIG. 1 is a sectional view illustrating a conventional cosmetic case.
Figure 2:
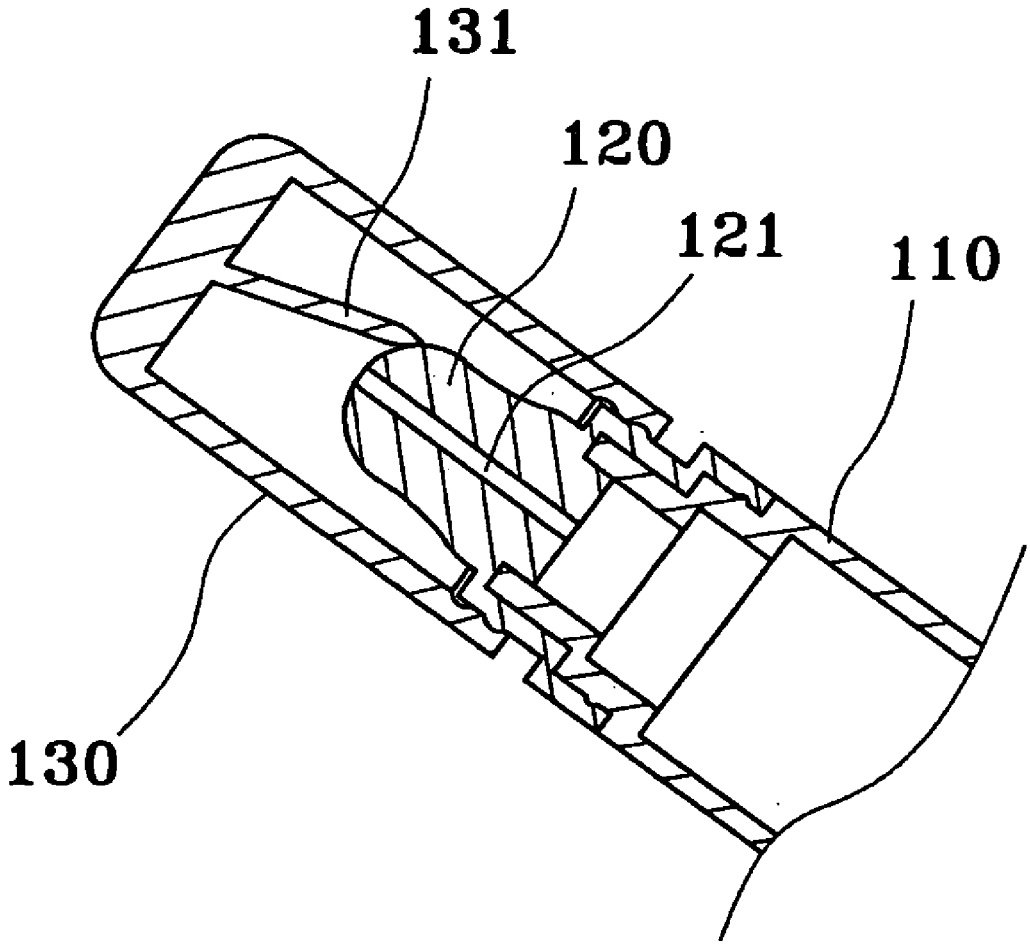
Fig. 2 Prior Art
FIG. 2 is a schematic diagram illustrating phenomena occurred when covering the case with a cap.
Figure 3:
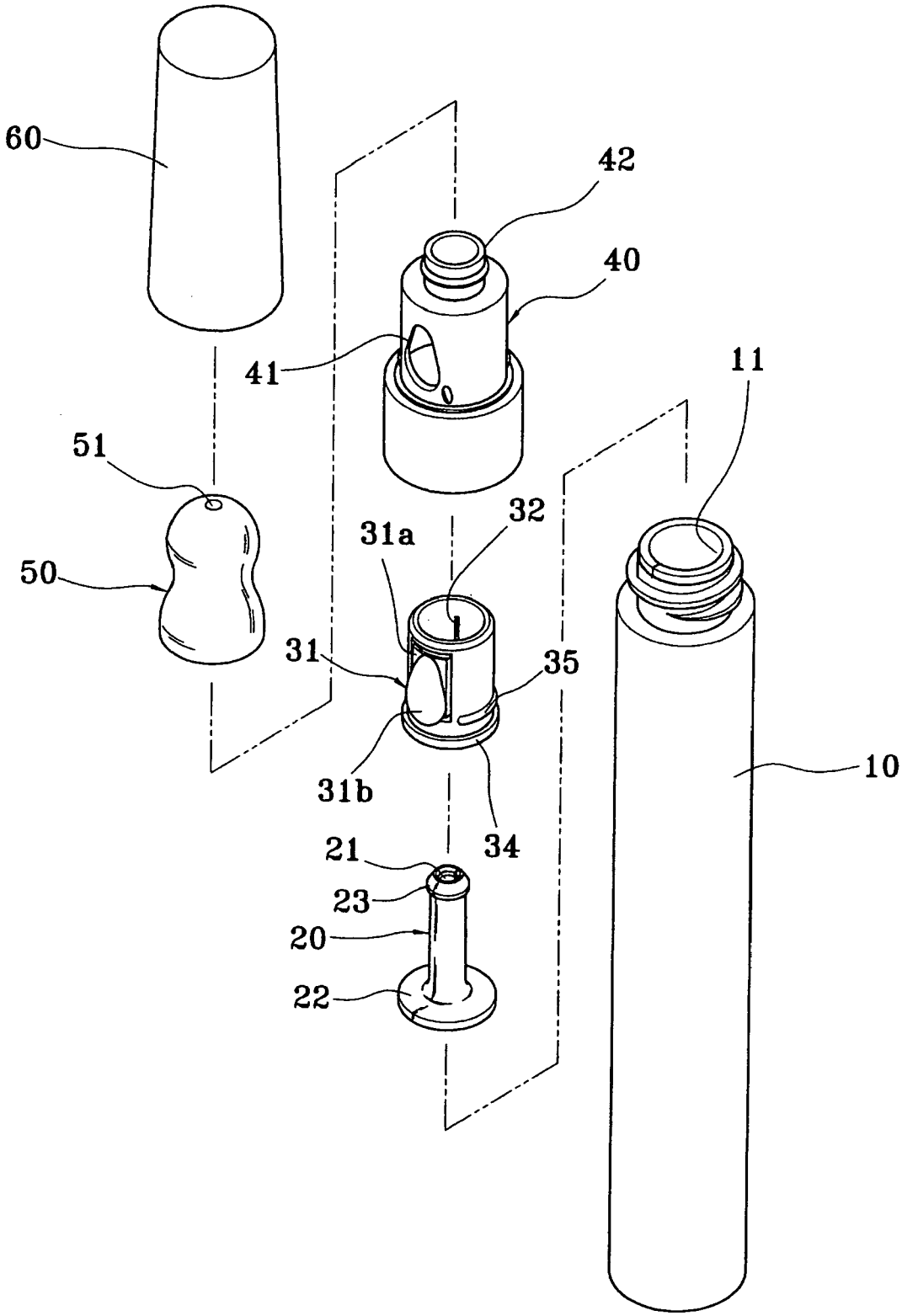
FIG. 3 is a disassembled prospective view illustrating a cosmetic case according to the embodiment of the present invention.
Figure 4:
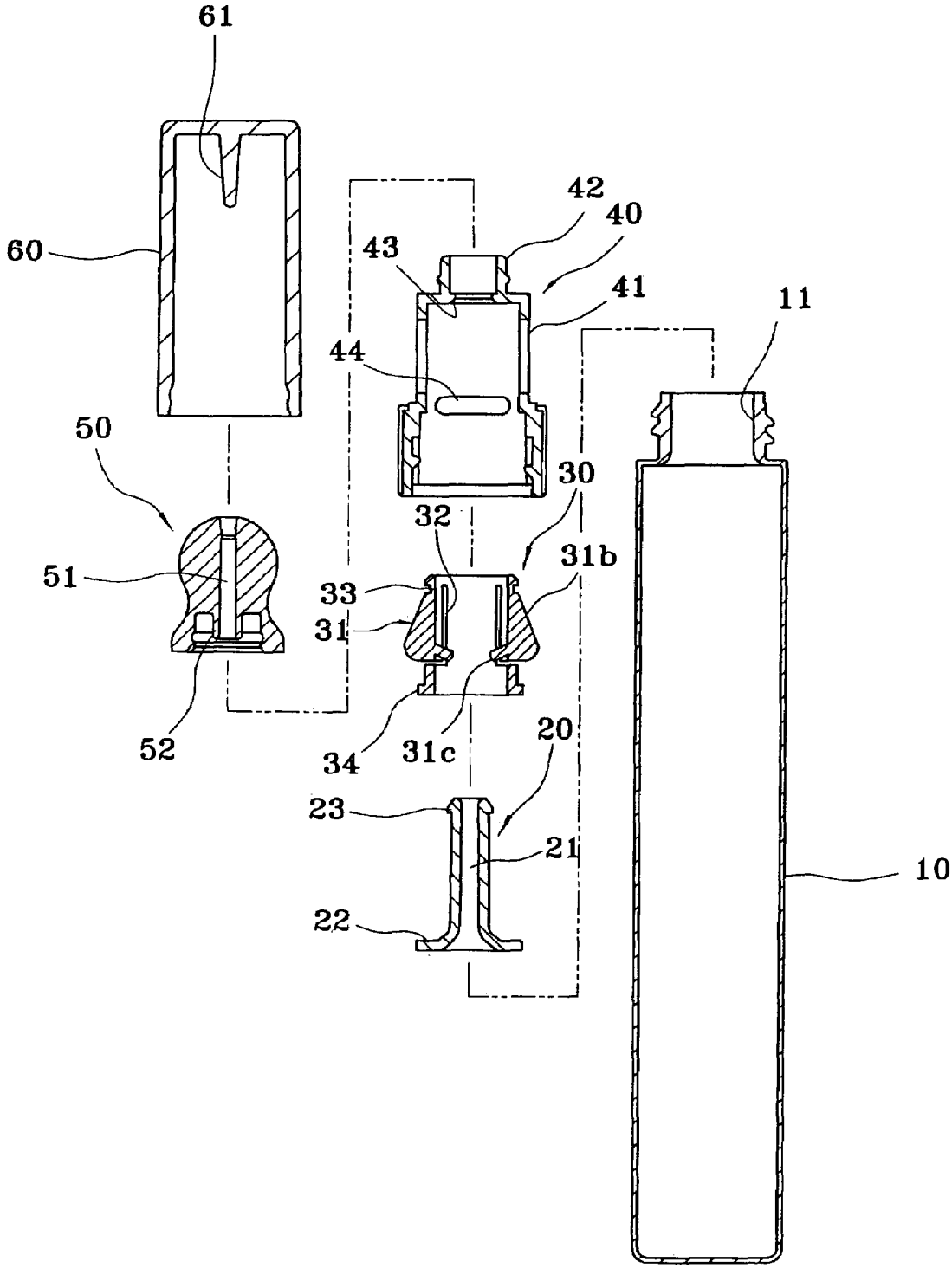
FIG. 4 is a disassembled sectional view illustrating the cosmetic case according to the embodiment of the present invention.

| | |
|---|---|
| 10; case | 11; opening portion |
| 20; content outlet | 21; content transferring path |
| 22; packing flange | 23; circular locking ledge |
| 30; opening/closing regulating member | 31; opening/closing knob |
| 31a; elastic piece | 31b; protruding portion |
| 31c; pressing limb | 40; outer body |
| 41; hole | 42; nozzle tip connector |
| 43; circular rim | 44; circular slit |
| 50; nozzle tip | 51; discharging hole |
| 52; pressing tube | 60; cap |

DETAILED DESCRIPTION OF THE INVENTION

Reference will now be made in detail to the embodiments of the present invention, examples of which are illustrated in the accompanying drawings, wherein like reference numerals refer to the like elements throughout. The embodiments are described below to explain the present invention by referring to the figures. For the sake of clearness and concision, technology related to the present invention that is not novel and is well known in the art to which present invention pertains will not be described herein.

The cosmetic case capable of opening/closing an content outlet according to the present invention, as shown in FIG. 3 through 6, is comprised of a content outlet 20 formed to align in parallel to the opening portion 11 of the case 10, an opening/closing regulating member 30, an outer body 40 which is located outside the opening/closing regulating member 30 and connected to the opening portion 11 of the case 10, a nozzle tip 50 connected to the upper portion of the outer body 40 and a cap 60 to protect the nozzle tip 50.

A packing flange 22 and a circular locking ledge 23 are formed in the lower portion and upper portion of the content outlet 20, respectively. The packing flange 22 is contacted, face to face, to the upper circumstance of the opening portion 11 of the case 10 and the circular locking ledge 23 is hanged to lock to a circular rim 43 which is formed in the lower and inner side of a nozzle tip connector 42 of the outer body 40.

The content outlet 20 is formed by a elastic material for example, rubber, which blocks the content transferring path 21 when it is pressed by a opening/closing knob 31 of the opening/closing regulating member 30 and restores to its original shape.

The opening/closing regulating member 30 is located outside the content outlet 20 and opens or closes the content outlet 20. The opening/closing regulating member 30 comprises of an elastic piece 31*a*, a protruding portion 31*b* which protrudes toward a hole 41 of the outer body 40 at the outer side of the elastic piece 31*a* and a pressing limb 31*c* which presses the content outlet 20 at the inner side of the elastic piece 31*a*. The elastic piece 31*a* is split by a cleaving crack 32 in its left, right and lower portion except its upper portion.

An elastic groove 33 is formed in the upper portion of the elastic piece 31*a*, which is not split, to ensure that the elastic piece 31*a* transforms smoothly. A flange 34 is formed in the lower portion of the opening/closing regulating member 30 and the flange 34 is contacted, face to face, to the packing flange 22 in the lower portion of the content outlet 20. A circular rim 35 is formed toward the opening/closing knob 31 at the right angle and the circular rim 35 is inserted to fix into the circular slit 44 which is formed on the inner side of the outer body 40.

The outer body 40 is located outside the opening/closing regulating member 30. The outer body 40 is connected to the opening portion 11 of the case 10 through a connecting means formed in its lower and inner side. A hole 41 is formed on the both sides of the outer body 40. The protruding portion 31*b* of the opening/closing knob 31 of the opening/closing regulating member 30 is inserted into the hole 41.

The circular rim 43 is formed in the inner side of a nozzle tip connector 42 to which the nozzle tip 50 is connected. And a circular locking ledge 23 in the upper portion of the content outlet 20 is hanged to fix to the circular rim 43.

The nozzle tip 50 is connected to the nozzle tip connector 42 in the upper portion of the outer body 40. The nozzle tip 50 is formed in the shape of a spear or a cone and is extended in parallel to the discharging hole 51 to form a pressing tube 52 which presses the upper portion of the content outlet 20 so that the circular locking ledge 23 is fixed to the circular rim 43 of the outer body 40.

The nozzle tip 50 is not limited to the structure and hard material as shown in the exemplary embodiment. The nozzle tip 50 can be made with soft material such as brush, rubber, cloth, sponge, etc.

A blocking stick 61 is provided in the center of the bottom side of the cap 60 which protects the nozzle tip 50. The cap 60 is formed possibly to connect to the outer body 40 which is located outside the opening/closing regulating member 30 in the under-cut manner.

The blocking stick 61, which is formed in the inner and bottom side of the cap 60, can be excluded when the nozzle tip 50 is made with a soft material such as brush, rubber, cloth, sponge, etc.

The cosmetic case according to the exemplary embodiment of the present invention is assembled as follows.

The opening/closing regulating member 30 is inserted inside the outer body 40 from bottom to top.

When the opening/closing regulating member 30 is assembled to the outer body 40 as described above, the opening/closing regulating member 30 is pressed into while the opening/closing knob 31 is aligned to fit to the hole 41. The opening/closing knob 31 is assembled initially while the protruding portion 31*b* formed on the outside of the elastic piece 31 is maintained to be folded by the inner surface of the outer body 40 and then the protruding portion 31*b* is protruded into the hole 41 when it is located at the hole 41 because the elastic piece 31*a* restores to its original shape by its own elastic force.

In the meantime, the circular rim 35, which is formed at the right angle with respect to the opening/closing knob 31, is inserted to the circular slit 44 formed on the inner surface of the outer body 40.

The content outlet 20 is assembled such that it is located inside the opening/closing regulating member 30 after the opening/closing regulating member 30 is assembled to the outer body 40.

The circular locking ledge 23 at the upper portion of the content outlet 20 is hanged to fix to the circular rim 43 formed in the lower and inner portion of the nozzle tip connector 42 of the outer body 40.

By this, the packing flange 22 of the content outlet 20, whose circular locking ledge 23 is fixed to the circular rim 43 of the outer body 43, is contacted, face to face, with the flange formed in the bottom portion of the opening/closing regulating member 30.

Then, the nozzle tip 50 is installed to the nozzle tip connector at the upper portion of the outer body 40 where the content outlet 20 and the opening/closing regulating member 30 are assembled as described above.

Installment of the nozzle tip 50 can be performed by various connecting method such as screw connection, under-cut connection, etc.

The pressing tube 52 is formed to be in parallel to the discharging hole 51 at the lower portion of the discharging hole of the nozzle tip 50, which is connected to the nozzle tip connector 42 of the outer body 40, Thus, the pressing tube 52 presses the upper portion of the content outlet 20, which is fixed to the circular rim 43 of the outer body 40, so that the circular locking ledge 23 is maintained to fix tightly.

Assembly of the case 10 is performed out by connecting the outer body 40, where the content outlet 20, the opening/closing regulating member 30 and the nozzle tip 50 are assembled, to the opening portion 11 of the case 10 by screw connecting manner or under-cut connection manner.

The cap 60, which protects the nozzle tip 50, is separated when doing tint-care makeup by discharging content from the cosmetic case which is assembled as described above.

Figure 5:
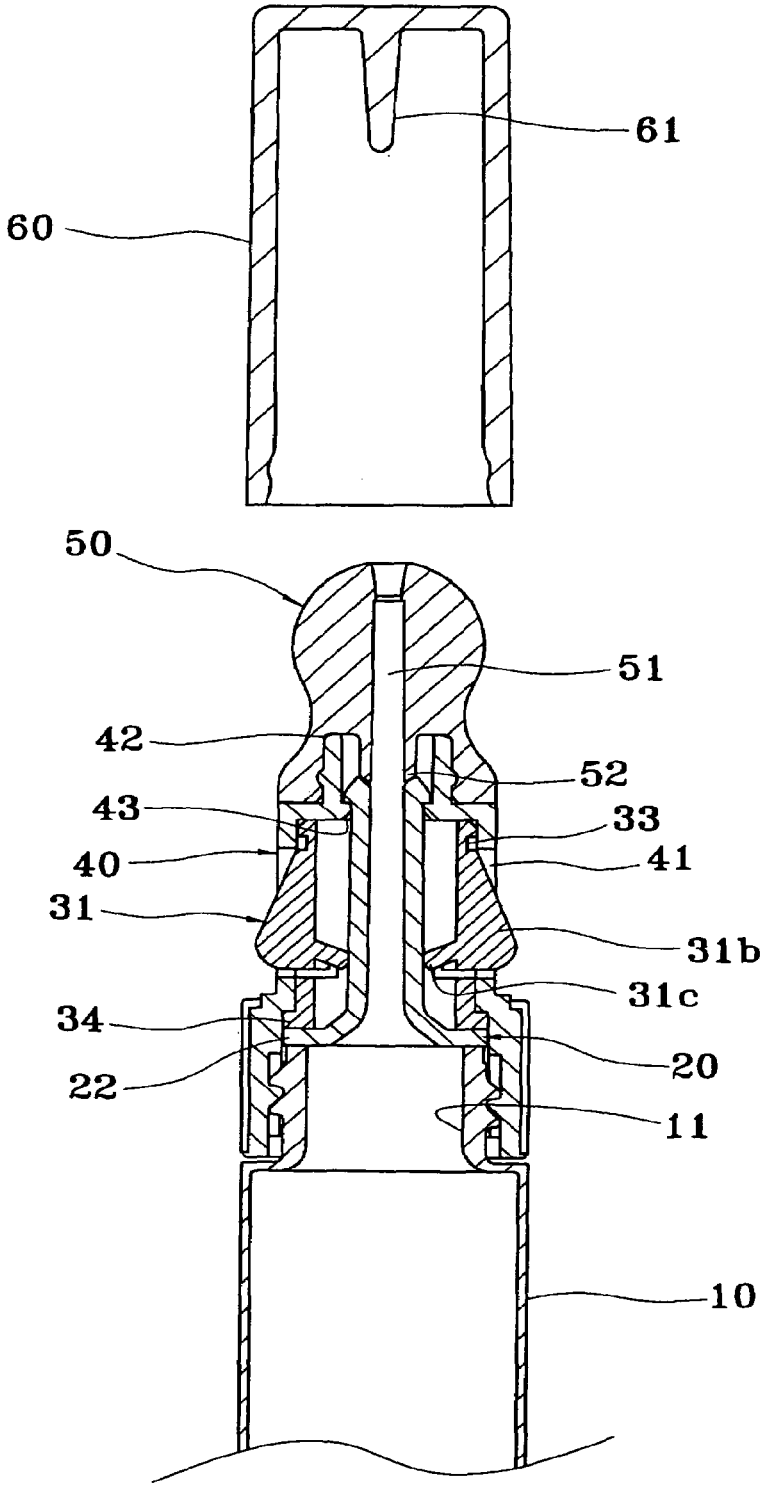
FIG. 5 is an assembled sectional view illustrating the state where content is discharged for makeup.

FIG. 5 shows a state where the cap 60 is separated. If the cap 60 is separated, the protruding portion 31*b* of the opening/closing knob 31, which has been pressed by the inner surface of the cap, becomes set to free.

If the protruding portion 31*b* is set to free, the elastic piece 31*a* of the opening/closing knob 31, which has been folded, is unfolded by its own elastic force to be restored to its original shape. At this time, the pressing limb 31*c*, which has pressed the content outlet 20, is separated from the content outlet 20.

Because the content outlet 20 is made by an elastic material for example, a rubber, it restores its original shape so that the content transferring path 21 is opened when the pressing limb 31*c* of the opening/closing knob 31 is separated.

The content, which is contained in the case 10, can be discharged outside the nozzle tip 50 at the state where the content transferring path 21 of the content outlet 20 is opened. After then, ladies can makeup by rubbing the discharged content from the nozzle tip 50 on the desired portion The content of the cosmetic case can be discharged by holding the case 20 upside down. Otherwise, it is discharged by pressing the cosmetic case when the cosmetic case is soft tube-type.

After finishing makeup, the nozzle tip 50 can be protected from pollution material by covering the nozzle tip 50 with the cap 60.

When the cap 60 is covered to protect the nozzle tip 60 the elastic piece 31*a* is folded inwardly because the protruding portion 31*b* of the opening/closing knob 31 is interfered by the inner surface of the cap 60, thereby the pressing limb 31*c*, which is formed inside the elastic piece 31*a*, presses the content outlet 20.

Figure 6:
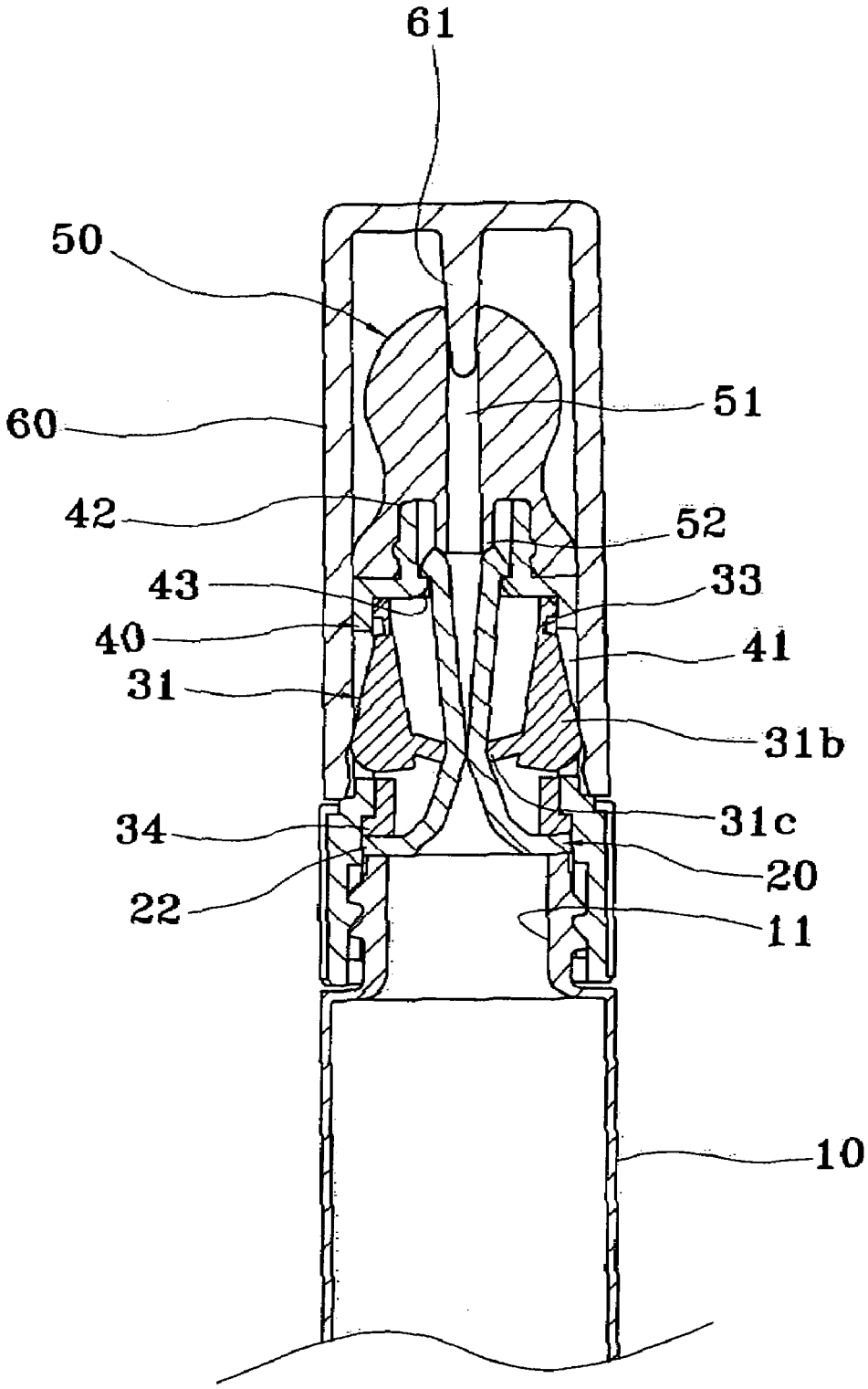
FIG. 6 is an assembled sectional view illustrating the state where the content outlet is blocked by a cap.

Because the content outlet 20 is pressed by the pressing limb 31*c* of the opening/closing knob 31, the content transferring path 21 becomes blocked as shown in FIG. 6, and thus leakage of the content and penetration of the air are blocked. Further, the blocking stick 61, which is formed at the inner and bottom side of the upper portion of the cap 60, is inserted into the discharging hole 51 of the nozzle tip 50 so that remained content outside the nozzle tip 50 is removed As described above, the cosmetic case of the present invention has advantages in that;

first, not only the nozzle tip 50 is protected form pollution material by the cap 60 but also content is prevented from discharging outside by blocking discharge of the content thoroughly as the content outlet 20 is pressed to block the content transferring path 21 by the pressing limb 31*c*, which is formed at the inner side of the elastic piece 31*a*, as the opening/closing knob 31 of the opening/closing regulating member 30 is transformed by the cap which is covered to protect the nozzle tip 50;

second, not only oil component is prevented from evaporating caused possibly by abnormal sealing but also content is maintained safely, thereby soft and beautiful makeup is always possible regardless of used duration of the tint-care cosmetic because the content transferring path is blocked by the opening/closing knob 31 of the opening/closing regulating member 30; and third, consumer can trust confidence of the product because hardened content does not exist even after finishing makeup with the tint-care cosmetic.

What is claimed is:

1. A cosmetic case capable of makeup by rubbing it on the desired portion of the skin, comprising:

a case (10) containing content;

a content outlet (20) where a packing flange (22) and a circular locking ledge (23) are formed at the lower portion and upper portion respectively, where in the packing flange (22) is contacted, face to face, with the upper circumference of an opening portion (11) of the case (10);

a opening/closing regulating member (30) having opening/closing knobs (31) on the both sides which opens and closes a content transferring path (21) of the content outlet (20) selectively;

an outer body (40) connected to the opening portion (11) of the case (10) where holes (41), to which the opening/closing knobs (31) of the opening/closing regulating member (30) are connected, are formed at the both sides and a nozzle tip connection portion (42), where a circular rim (43) is provided in the inner side, is formed at the upper portion;

a nozzle tip (50) connected to the nozzle tip connection portion (42) at the upper portion of the outer body (40) and having a pressing tube (52) which is extended in parallel to a discharging hole (51) so as at to press the circular locking ledge (23) of the content outlet (20) so that the circular locking ledge (23) is fixed tightly to the circular rim (43) of the outer body (40); and a cap (60) to protect the nozzle tip (50) and operate the opening/closing knobs (31) of the opening/closing regulating member (30) when separated.

2. The cosmetic case in claim 1, wherein the content outlet is made with a rubber which can be contracted by the opening/closing knobs of the opening/closing regulating member.

3. The cosmetic case in claim 1, wherein the opening/closing knobs comprise of:

an elastic piece (31*a*) whose left side, right side and lower portion except upper portion are split by a cleaving crack (32) and where an elastic groove (33) is formed on its upper portion;

a protruding portion (31*b*) restrained by the cap (60) on the outer surface of the elastic piece (31*a*) and protruded into the holes (41) of the outer body (40); and a pressing limb (31*c*) formed inside to press the content outlet (20).

* * * * *